US006710674B2

(12) United States Patent
Pitschi

(10) Patent No.: US 6,710,674 B2
(45) Date of Patent: Mar. 23, 2004

(54) WAVEGUIDE FITTING

(75) Inventor: Franz Pitschi, Rottach-Egern (DE)

(73) Assignee: Spinner GmbH Elektrotechnische Fabrik, Munich (DE)

( * ) Notice: Subject to any disclaimer, the term of this patent is extended or adjusted under 35 U.S.C. 154(b) by 85 days.

(21) Appl. No.: 10/057,396

(22) Filed: Jan. 25, 2002

(65) Prior Publication Data

US 2002/0109559 A1 Aug. 15, 2002

(30) Foreign Application Priority Data

Jan. 26, 2001 (DE) ..... 101 03 576

(51) Int. Cl.[7] ..... H01P 1/16
(52) U.S. Cl. ..... 333/21 R; 333/251; 333/254
(58) Field of Search ..... 333/254, 251, 333/33–35, 21 R; 285/9.2, 236, 405, 406, 407, 411, 148.22, 148.27, 322, 903, 243

(56) References Cited

U.S. PATENT DOCUMENTS 3,705,379 A * 12/1972 Bogar ..... 439/581
3,784,939 A * 1/1974 Maeda et al. ..... 333/254
4,540,959 A * 9/1985 Saad ..... 333/21 R
4,642,585 A * 2/1987 Saad ..... 333/21 R
4,786,883 A * 11/1988 Spinner ..... 333/21 R
5,886,588 A * 3/1999 Schneider ..... 333/21 R
6,267,415 B1 * 7/2001 Frank ..... 285/255
6,419,281 B1 * 7/2002 Salomon-Bahls et al. ... 285/307

* cited by examiner

*Primary Examiner*—Robert Pascal
*Assistant Examiner*—Kimerly E Glenn
(74) *Attorney, Agent, or Firm*—Husch & Eppenberger, LLC; Robert E. Muir; Robert C. Haldiman

(57) ABSTRACT

A waveguide fitting for connecting in particular a rectangular waveguide to an elliptical waveguide can be assembled particularly easily and yet provides a very low-reflection connection if the fitting at least at one end is conductively provided with the first section of a sleeve of which the second section is designed to receive the end region of the waveguide to be connected and which is divided at least in this second section by narrow capillary-action axial slots into radially springing lamellae which, after insertion of the waveguide, abut against the outer wall thereof, and in addition the inner wall at least of the second section of the sleeve is designed to receive a solder deposit. To make the connection, it is then necessary only to heat the whole junction with an external heat source until the solder in the solder deposits melts and fills the gaps between the inner wall of this section of the sleeve and the outer wall of the waveguide.

12 Claims, 6 Drawing Sheets

WAVEGUIDE FITTING

TECHNICAL FIELD OF THE INVENTION

The invention concerns a waveguide fitting for connecting two waveguides, in particular for connecting a rectangular waveguide to an elliptical waveguide.

DESCRIPTION OF THE RELATED ART

At its simplest, two waveguides to be connected have the same cross-section and mating connecting flanges which can be screwed together. For the connection of two waveguides of different square or rectangular cross-section, waveguide fittings which have a transforming effect and also can be equipped at both ends with e.g. screw flanges, are used as a rule. It is more difficult if (at least) one of the two waveguides consists of a thin-walled metal tube, in particular if it is one of the commonly used so-called elliptical waveguides, that is, a waveguide of approximately elliptical cross-section, and for obtaining a certain flexibility with helically corrugated tube casing. Connection to a standard waveguide, e.g. a rectangular waveguide, or to the waveguide fitting which forms the transforming matching bar is then a time-consuming task which can be performed only by skilled personnel and which requires the use of special, expensive beading machines and many assembly steps to obtain a high-quality, i.e. low-reflection connection.

SUMMARY OF THE INVENTION

It is the object of the invention to provide a waveguide fitting which, with simple means and little expenditure, can be connected to a waveguide which has a non-rectangular and in particular an ellipse-like cross-section and at the same time ensures that the connection made has very low reflection and intermodulation.

This object is achieved according to the invention by the fact that the fitting at least at one end is conductively connected to the first section of a sleeve of which the second section is designed to receive the end region of the waveguide to be connected and which is divided at least in this second section by narrow capillary-action axial slots into radially springing lamellae which, after insertion of the waveguide, at least partially abut against the outer wall thereof, and that the inner wall at least of the second section of the sleeve is designed to receive at least one solder deposit.

Before or after application of the solder deposit, the waveguide to which the connection is to be made need only be cut to the right length and inserted in the second section of the sleeve until it abuts. Then the junction is heated until proper soldering occurs. This can be monitored from the outside, because the slots in the sleeve are kept so narrow that the melted solder fills them as a result of a capillary effect. Therefore the connection can also be made reliably at the point of assembly itself and by personnel who are not highly skilled, e.g. personnel of the operator of the plant concerned, and checked for its quality.

Generally, this waveguide fitting has at its other end an ordinary flange for connection to the flange of a standard waveguide, e.g. a rectangular waveguide. Basically, however, the waveguide fitting can be designed inversely symmetrically, that is, provided with a second, correspondingly shaped sleeve. The fitting according to the invention is therefore basically suitable for the connection of two waveguides of any cross-section (except rectangular), or for the connection of e.g. a rectangular waveguide to a smooth-walled waveguide, or a waveguide with a corrugated wall and circular or ellipse-like cross-section.

BRIEF DESCRIPTION OF THE DRAWINGS

Reference is now made to the drawings which illustrate the best known mode for the apparatuses; and wherein similar reference characters indicate the same parts throughout the several views.

DETAILED DESCRIPTION

Figure 1:
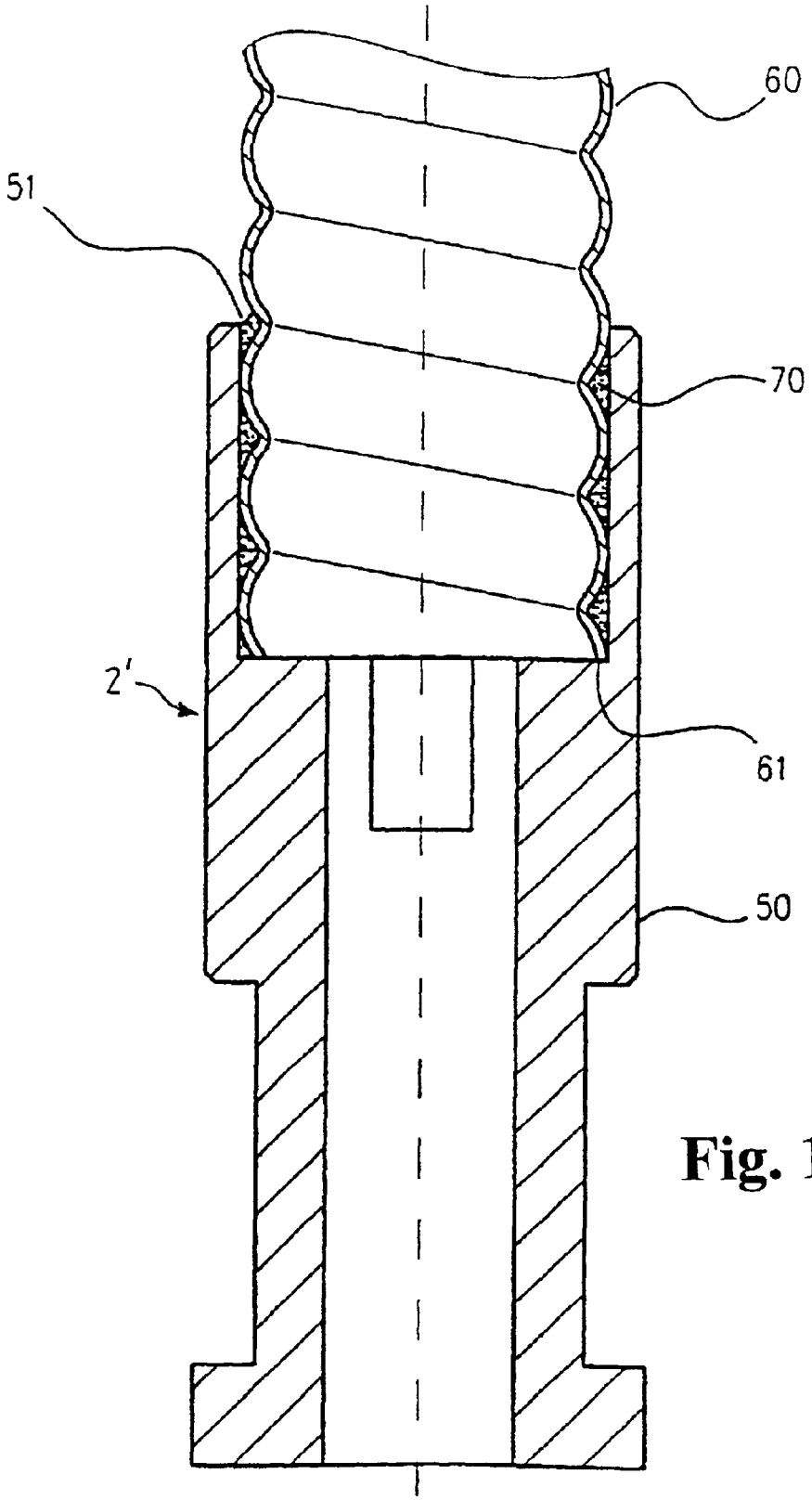
FIG. 1 is a cross-sectional view of a waveguide fitting soldered to an elliptical waveguide.
Figure 2:
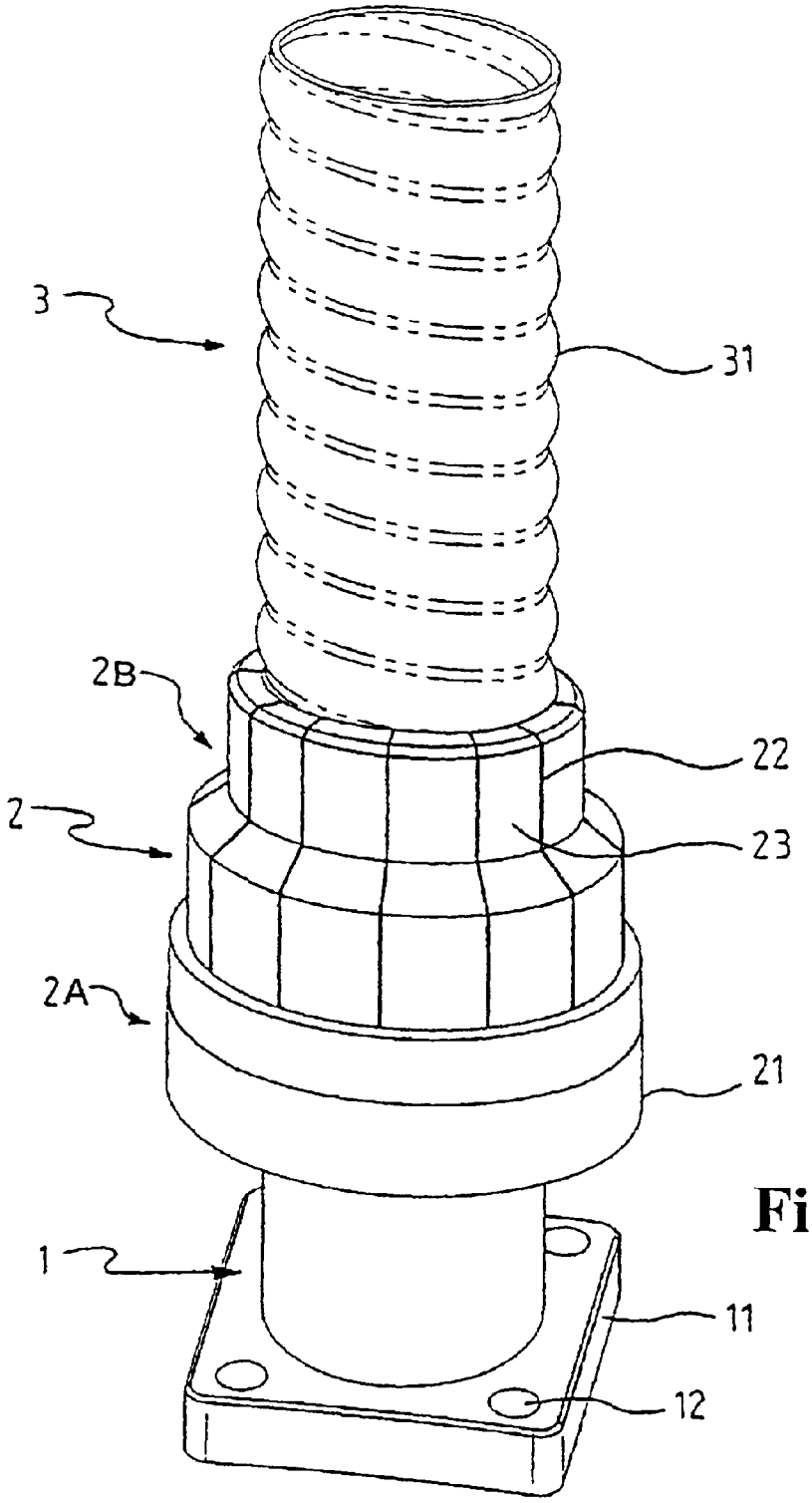
FIG. 2 is a perspective view of a waveguide fitting with an elliptical waveguide connected.
Figure 3:
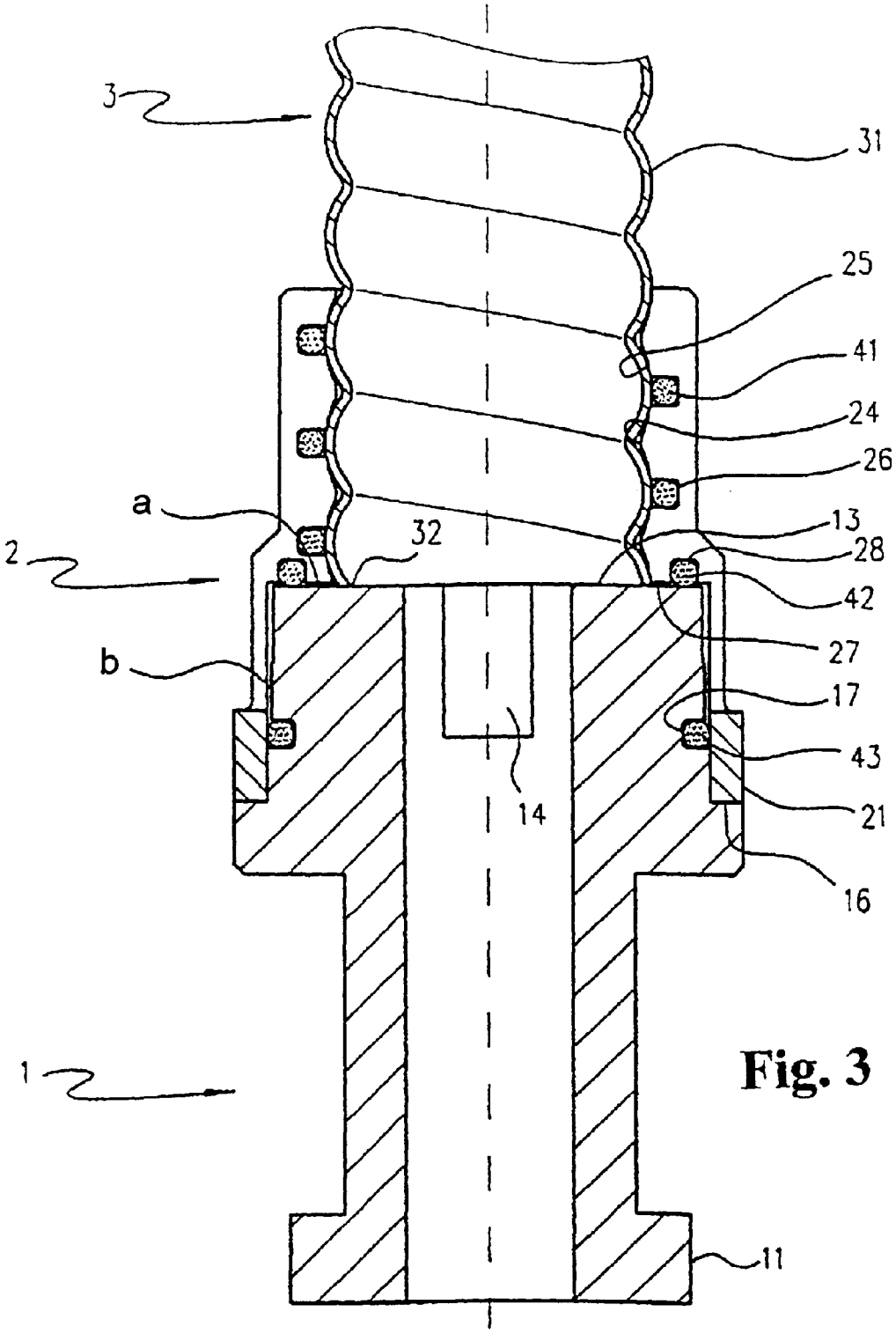
FIG. 3 is a longitudinal section of the arrangement shown in FIG. 2.

FIG. 1 shows a fitting 50 which at its upper end has a recess corresponding to the (e.g. circular or elliptical) cross-section of a waveguide 60. In this recess is held the end section of the waveguide 60, which is corrugated helically. A shaped solder part 70 is laid in an integral sleeve 2'. The shaped solder part 70 is profiled according to this corrugation and surrounds the end of the waveguide 60 over a length corresponding to the depth of the recess in the fitting 50. The shaped solder part 70 can consist of a correspondingly profiled and wound strip of solder material or of corresponding preformed assembled half-shells. The shaped solder part 70 can in particular be designed as a ring, as a film or as a sleeve, and if necessary also constructed in the form of two half-shells. After insertion of the waveguide 60 including the shaped solder part 70 in the recess of the fitting 50, the connecting region is heated until the solder melts. Melting of the solder can however be observed only in the narrow edge zone 51 at the end of the fitting 50. It cannot be checked from the outside whether the solder is also fully melted in the region of the end edge 61 of the waveguide 60 and has formed a reliable solder joint or whether conversely excess solder has flowed around this end edge 61 into the interior of the fitting 50, which could noticeably increase the reflection factor at this junction. This embodiment therefore may not be suitable for high-quality joints.

Figure 4:
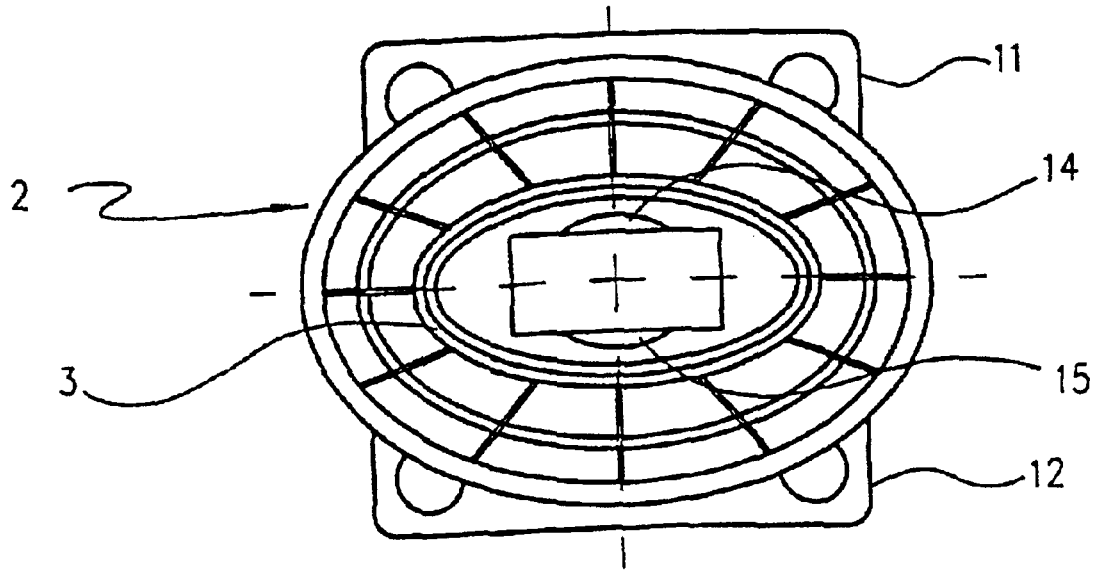
FIG. 4 is a top view thereof.

FIGS. 2 to 5 by contrast show a preferred embodiment. Preferably, a waveguide fitting 1 serves for connection to a helically corrugated, so-called elliptical waveguide 3. The waveguide fitting 1 is provided at its lower end with a flange 11 with holes 12 for screwing to e.g. an ordinary rectangular waveguide (not shown) and connected by its upper end to a so-called elliptical waveguide 3. The fitting 1 carries a sleeve 2 with a first section 2A which is conductively connected to the fitting 1 and a second section 2B which is designed to receive the end region of the elliptical waveguide 3. The second section of the sleeve 2 has an inner profile approximately complementary to the helical corrugation of the waveguide 3. A portion of the length of the sleeve 2 overlaps the upper end region of the fitting 1. With the other portion of its length the sleeve 2 overlaps approximately three helical corrugation turns (see FIG. 3) of the elliptical waveguide 3 whose cross-section is however only ellipse-like, as FIG. 4 shows. Such waveguides are known in the state of the art, e.g. sold under the name FLEXWELL by the firm RFS in Hannover, Germany.

As is known in the art, the fitting 1 simultaneously acts as a transformer which converts into each other the different wave types which are propagated on the one hand in the rectangular waveguide (not shown) and on the other hand in the elliptical waveguide 3. For this purpose the fitting 1 can have, starting from its upper end surface 13, mutually opposed shell-like recesses 14, 15 which widen its rectangular inner cross-section over a given length (see FIG. 4). The geometry of such fittings, which depends on the frequency, cross-section and wave type, is known to those skilled in the art and is therefore not the subject of this invention.

The sleeve 2 is made of a metallic, easy-to-solder and resilient material and can be silver-plated. The sleeve 2 includes a solid ring 21 with which the sleeve 2 abuts against an annular shoulder 16 of the fitting 1 e.g. in a press fit and surrounds the latter on the outside. Over the remainder of its length the sleeve 2 is divided by numerous narrow slots 22 into the same number of lamellae 23 which have their roots at the ring 21.

Both in order to give the lamellae 23 sufficient springing capacity and in order not to make the thermal capacity of the sleeve 2 unnecessarily high, the outside diameter of the sleeve 2 decreases in two steps in the region of the lamellae 23, measured in the direction of both the major and the minor axis of the ellipse-like cross-section (see FIG. 4), in order to adapt to the axial dimension of the elliptical waveguide 3, which is smaller in both axes.

The inside dimension of the sleeve 2 is designed in the region of its section which receives the waveguide 3 in such a way that after insertion of the waveguide 3 the lamellae 23 are in resilient spring contact with its corrugation peak 31. The inner contour 24 of the sleeve 2 follows the approximately helical profile of the corrugation of the waveguide 3, without therefore being exactly complementary to this corrugation. It is important only that the approximately helical trough 25 of the inner profile of the sleeve 2 follows the approximately helical peak line of the helical corrugation of the waveguide 3. Preferably, however, the inner contour 24 of the sleeve 2 is offset by a small amount in the axial direction from the helical profile of the waveguide 3, so that after insertion of the waveguide 3 there arises an axial force component which acts on the waveguide 3 in the direction of the end surface 13 of the fitting 1. Hence on the one hand it is ensured that the waveguide 3 latches in the inner contour 24 of the sleeve 2 and that the end edge 32 of the waveguide 3 abuts against the end surface 13 of the fitting 1. On the other hand this measure produces a slight clamping of the waveguide 3 in the recess of the sleeve 2, which can make it superfluous to fix the fitting 1 separately relative to the waveguide 3 during the subsequent soldering process.

In the trough 25 of the inner profile 24 of the second section of the sleeve 2 runs, beginning roughly at the level of the first corrugation peak 31, a groove 26 in the sleeve 2 which is correspondingly also approximately helical. The helical groove 26 can run roughly in the trough of the inner profile of the second section of the sleeve 2 which is complementary to the helical corrugation of the waveguide 3. In the groove 26 is laid a solder deposit. Advantageously, the solder deposit can consist of flux-containing solder wire 41, optimally solder wire larded (or interlarded) with flux.

Particularly in the case of waveguides having larger dimensions, alternatively the helical groove 26 in the complementary inner profile of the second section of the sleeve 2 can roughly follow the trough of the helical corrugation of the waveguide 3. In all embodiments the depth of the groove 26 is selected such that there is reliable heat-conducting contact between the solder wire 41 and the corrugation peaks 31 of the waveguide 3.

The sleeve 2 can have, between its first and its second section, an ellipse-like annular surface 27 which lies in a radial plane and which is spaced apart from an end surface 13 of the fitting 1 by a capillary gap a, wherein between the ellipse-like annular surface 27 and the end surface 13 of the fitting 1 is formed a second solder deposit. This second solder deposit also preferably consists of flux-containing solder wire 42 in a groove 28 in the ellipse-like annular surface 27 of the sleeve 2. This second solder deposit ensures that there is reliable end edge 32 contact between the fitting 1 and the connected waveguide 3 over the whole circumference after soldering, that at the same time the junction is RF-shielded from the outside, and that the connected waveguide 3 is reliably mechanically supported by the sleeve 2, i.e. rigidly connected to the fitting 1. The second solder wire 42 larded (or interlarded) with flux is located in the ellipse-like annular surface 27, in a groove 28 approximately the same distance from the end edge 32 of the waveguide 3 over the circumference thereof. Alternatively the groove 28 can be located in the end surface 13. Groove 28 and groove 26 are separate. In small waveguide cross-sections, the groove 28 can be dispensed with. The groove 26 then begins in the plane of the end surface 13.

Preferably, the end of the sleeve 2 on the fitting side is designed as a solid ring 21 and rigidly connected to the fitting 1. The fitting 1 has a groove 17 on the outside at the level of the ring 21 of the sleeve 2. This groove 17 could alternatively be located in the inner surface of the ring 21. Between the inner circumferential surface of this ring and the outer circumferential surface region of the fitting 1 covered by it, is arranged at least one further solder deposit. Again this further (or third) solder deposit can consist of a flux-containing solder wire 43 in a circumferential groove 17 which can be provided in the inner circumferential surface of the ring of the sleeve 2 or the outer circumferential surface of the fitting 1 in its region covered by the sleeve 2. The groove 17 containing the third solder deposit is adjoined by a capillary gap b between the roots of the lamellae 23 of the sleeve 2 and the outer circumferential surface of the fitting 1 in this region. This third solder deposit causes the sleeve 2 to be practically in one piece with the fitting 1 after soldering. Hence this further solder deposit also makes a contribution to the rigid connection between the fitting 1 and the connected waveguide 3.

Figure 5:
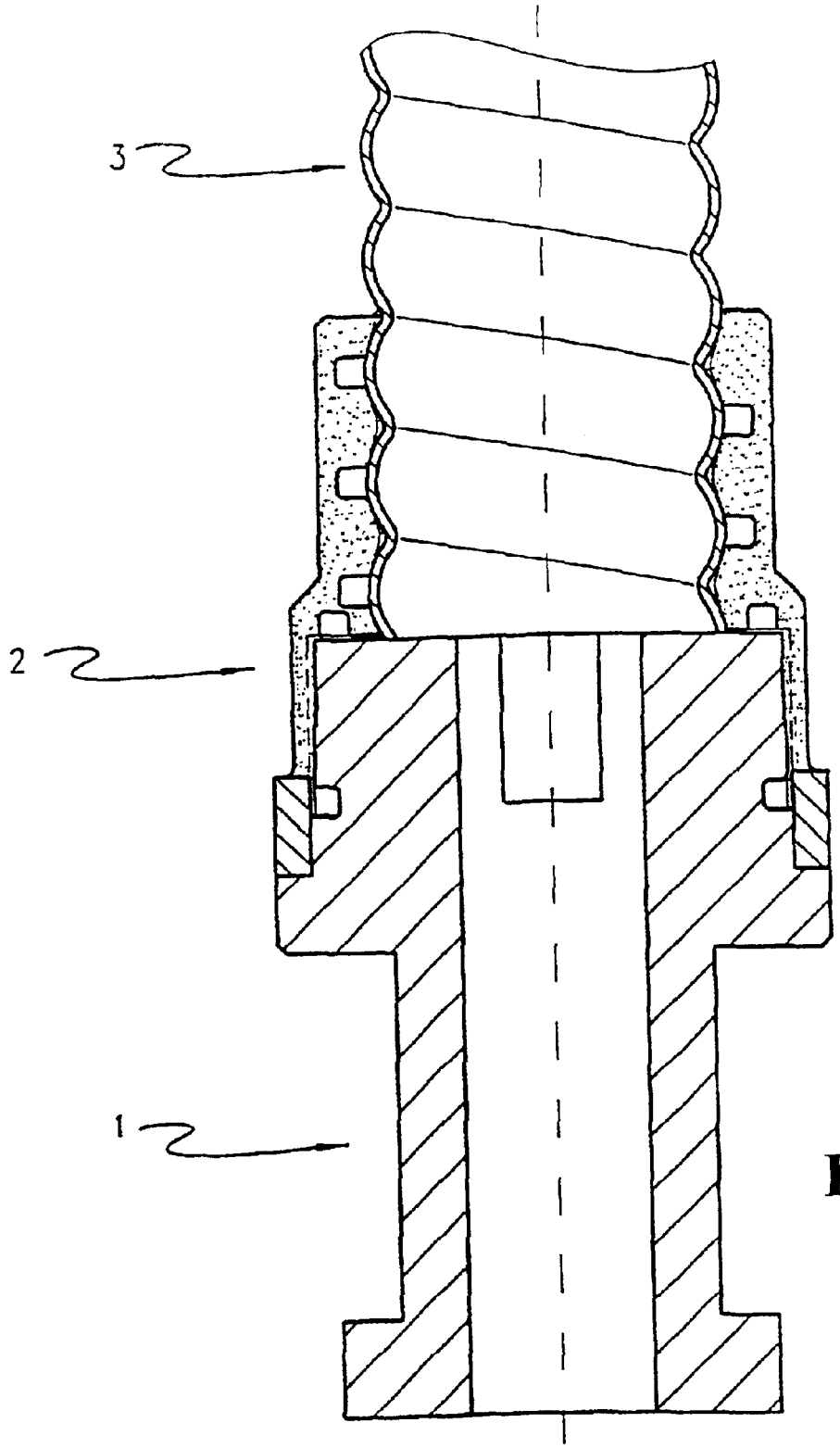
FIG. 5 is a longitudinal section like FIG. 3, but after soldering.

For connection to the fitting 1, the waveguide 3 cut off in plane fashion and at right angles to its longitudinal axis as well as in the correct position relative to its corrugation is inserted in the sleeve 2 until its end edge 32 abuts against the end surface 13. Then the whole junction is heated, e.g. with a soldering torch, until the solder of all three solder deposits (wires) 41, 42, 43 turns liquid, and, assisted by the flux, completely fills the adjacent gaps according to their capillary effect. After heating, the liquid solder then not only fills the capillary gaps a and b completely and so provides a wide ring by which the sleeve 2 is soldered to the fitting 1, but under the capillary action also fills the slots between the roots of the lamellae 23 of the sleeve 2, which at the same time in this region too allows visual control of the quality of soldering from the outside. This is easy to detect and monitor from the outside from the fact that the slots 22 in the sleeve 2 become filled with solder over their whole length. If the inner contour 24 of the sleeve 2 does not have the above-mentioned axial offset from the corrugation of the waveguide 3, it is appropriate to exert an axial force on the fitting 1 in the direction of the waveguide 3 during heating of the junction. FIG. 5 shows the areas between the lamellae after soldering. The regions covered by solder or filled with it are shown by stippling, i.e. dotted.

Figure 6:
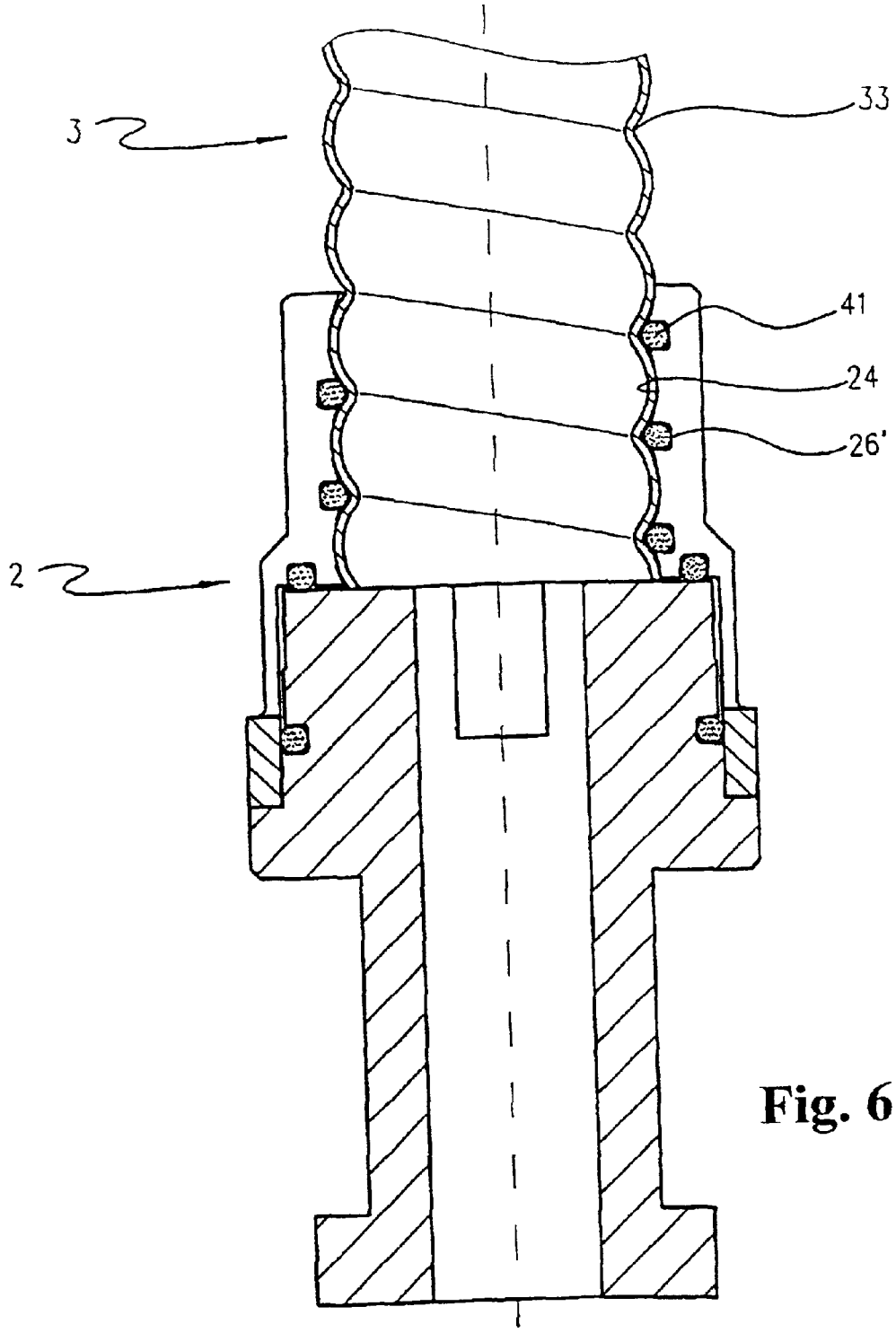
FIG. 6 is a longitudinal section of a modified arrangement comprising of a waveguide fitting according and an elliptical waveguide.

FIG. 6 shows an embodiment which is particularly suitable for waveguides with large cross-sectional dimensions. As in the case of the embodiment described above, the inner contour 24 of the sleeve 2 follows the approximately helical profile of the corrugation of the waveguide 3. The difference is that the helical groove 26' in which the solder wire 41 is laid does not run in the trough (25 in FIG. 3) of the inner contour 24 but is offset by half the height of a turn, so that it follows the helical corrugation peak 33 of the waveguide 3.

While preferred embodiments of the invention have been illustrated and described, this has been done by way of illustration and the invention should not be limited except as required by the scope of the appended claims.

What is claimed is:

1. A waveguide fitting for connecting two waveguides, including a sleeve having first and second sections which are conductively connected; the second section being arranged for receiving an end region of one of the two waveguides to be connected; the second section being divided by narrow capillary-action axial slots into radially springing lamellae on an inner wall of the second section; the lamellae abutting against an outer wall of the one waveguide after insertion thereof; and the inner wall of the second section of the sleeve being constructed and arranged to receive a solder deposit.

2. A waveguide fitting according to claim 1, characterized in that the solder deposit is a shaped solder part laid in the sleeve.

3. A waveguide fitting according to claim 1, for connection to a helically corrugated, elliptical waveguide, characterized in that the second section of the sleeve which receives the elliptical waveguide has an inner profile approximately complementary to the helical corrugation of the eliptical waveguide.

4. A waveguide fitting according to claim 3, characterized in that the solder deposit consists of flux-containing solder wire in a helical groove in the inner wall of the second section of the sleeve.

5. A waveguide fitting according to claim 4, characterized in that the helical groove runs roughly in a trough of an inner profile of the second section of the sleeve, and the inner profile is complementary to the helical corrugation of the waveguide.

6. A waveguide fitting according to claim 5, characterized in that the helical groove in the complementary inner profile of the second section of the sleeve roughly follows the trough of the helical corrugation of the waveguide.

7. A waveguide fitting according to claim 1, characterized in that the sleeve has, between its first and its second section, an annular surface which lies in a radial plane and which is spaced from an end surface of the fitting by a capillary gap; and in that between the annular surface and the end surface of the fitting a second solder deposit is formed.

8. A waveguide fitting according to claim 7, characterized in that the second solder deposit includes a flux-containing solder wire in a groove in the annular surface of the sleeve.

9. A waveguide fitting according to any of claim 8, characterized in that the end of the sleeve on the fitting side is a solid ring; and in that between an inner circumferential surface of the ring and an outer circumferential surface of the fitting covered by the ring is arranged a further solder deposit.

10. A waveguide fitting according to claim 9, characterized in that the further solder deposit adjoins a capillary gap between roots of the lamellae of the sleeve and the outer circumferential surface of the fitting.

11. A waveguide fitting according to claim 9, characterized in that the further solder deposit consists of flux-containing solder wire in a circumferential groove in the inner circumferential surface of the ring of the sleeve.

12. A waveguide fitting according to claim 9, characterized in that the further solder deposit consists of flux-containing solder wire in a circumferential groove in the outer circumferential surface of the fitting in its region covered by the sleeve.

* * * * *